US008105185B2

(12) United States Patent
Tanaka

(10) Patent No.: US 8,105,185 B2
(45) Date of Patent: Jan. 31, 2012

(54) SHUTTLECOCK

(75) Inventor: Kensuke Tanaka, Saitama (JP)

(73) Assignee: Yonex Kabushiki Kaisha, Tokyo (JP)

( * ) Notice: Subject to any disclaimer, the term of this patent is extended or adjusted under 35 U.S.C. 154(b) by 13 days.

(21) Appl. No.: 12/744,945

(22) PCT Filed: Aug. 21, 2008

(86) PCT No.: PCT/JP2008/064876

§ 371 (c)(1),
(2), (4) Date: Jul. 28, 2010

(87) PCT Pub. No.: WO2009/069349

PCT Pub. Date: Jun. 4, 2009

(65) Prior Publication Data

US 2010/0311526 A1 Dec. 9, 2010

(30) Foreign Application Priority Data

Nov. 30, 2007 (JP) ..... 2007-311235

(51) Int. Cl.
*A63B 67/18* (2006.01)

(52) U.S. Cl. ..... 473/579

(58) Field of Classification Search ..... 473/579, 473/580

See application file for complete search history.

(56) References Cited

U.S. PATENT DOCUMENTS

| | | | | |
|---|---|---|---|---|
| 2,830,817 | A * | 4/1958 | Schoberl | 473/579 |
| 3,313,543 | A * | 4/1967 | Carlton | 473/579 |
| 4,509,761 | A | 4/1985 | Liu | |
| 5,421,587 | A * | 6/1995 | Mao-Huang | 473/579 |
| 5,853,340 | A * | 12/1998 | Willis | 473/579 |
| 6,227,991 | B1 | 5/2001 | Carlton et al. | |

FOREIGN PATENT DOCUMENTS

| | | |
|---|---|---|
| JP | 2-29974 Y2 | 8/1990 |
| JP | 3181059 B2 | 7/2001 |

* cited by examiner

*Primary Examiner* — John Ricci

(74) *Attorney, Agent, or Firm* — McDermott Will & Emery LLP

(57) ABSTRACT

A shuttlecock including a cap and a skirt part whereto an air passage hole is formed, wherein a rib is provided to the skirt part, adjacent to a rear end of the air passage hole in a generatrix direction of the skirt part, the rib having a shape wherein air pressure difference is generated between an air flow passing through the air passage hole to flow on an inside of the rib and an air flow not passing through the air passage hole but to flow on an outside of the rib, and an aerodynamic force directed from the inside of the rib to the outside is generated.

6 Claims, 11 Drawing Sheets

SHUTTLECOCK

CROSS REFERENCE TO PRIOR APPLICATIONS

This application is a U.S. National Phase application under 35 U.S.C. §371 of International Application No. PCT/JP2008/064876, filed on Aug. 21, 2008 and claims benefit of priority to Japanese Patent Application No. 2007-311235, filed on Nov. 30, 2007. The International Application was published in Japanese on Jun. 4, 2009 as WO 2009/069349 under PCT Article 21(2).

TECHNICAL FIELD

The present invention relates to a shuttlecock used in playing badminton.

BACKGROUND ART

A shuttlecock equipped with a cap and a skirt part adjacent to the cap is widely used in badminton. An air passage hole is formed to the skirt part of the shuttlecock, and an air flow directed to the skirt part passes through the air passage hole when the shuttlecock flies in the air.

On the other hand, when the shuttlecock is struck by a racket in a badminton game, the skirt part collapses by such strike (for example, refer to PTL 1).

Citation List

Patent Literature

PTL 1 Japanese Patent No. 3181059

SUMMARY OF INVENTION

Technical Problem

A player can hardly play badminton in a way he wants, if the play continues while the skirt part remains in a collapsed state. For example, in the case where the shuttlecock flies in the air with the collapsed skirt part, an appropriate air resistance cannot be provided to the shuttlecock. In such case, when a shuttlecock is struck, such as a smash, that accelerates the speed of the shuttlecock the shuttlecock may fly too fast, or the shuttlecock may fly out of court because of flying too far (so-called back out).

For the above reason, in the case the skirt part collapses, it is preferable that it is promptly recovered.

The present invention was made in view of the foregoing issue, and it is an object thereof to promptly recover the skirt part in the case where the skirt part has collapsed.

Technical Solution

The main aspect of the present invention for solving the foregoing issue is:

a shuttlecock including a cap and a skirt part whereto an air passage hole is formed, having a rib provided to the skirt part, adjacent to a rear end of the air passage hole in a generatrix direction of the skirt part, the rib having a shape wherein air pressure difference is generated between an air flow passing through the air passage hole to flow on an inside of the rib and an air flow not passing through the air passage hole but to flow on an outside of the rib, whereby an aerodynamic force directed from the inside of the rib to the outside is generated.

Other features of the invention will become clear by the description of the present specification and the accompanying drawings.

BEST MODE FOR CARRYING OUT THE INVENTION

Figure 1:
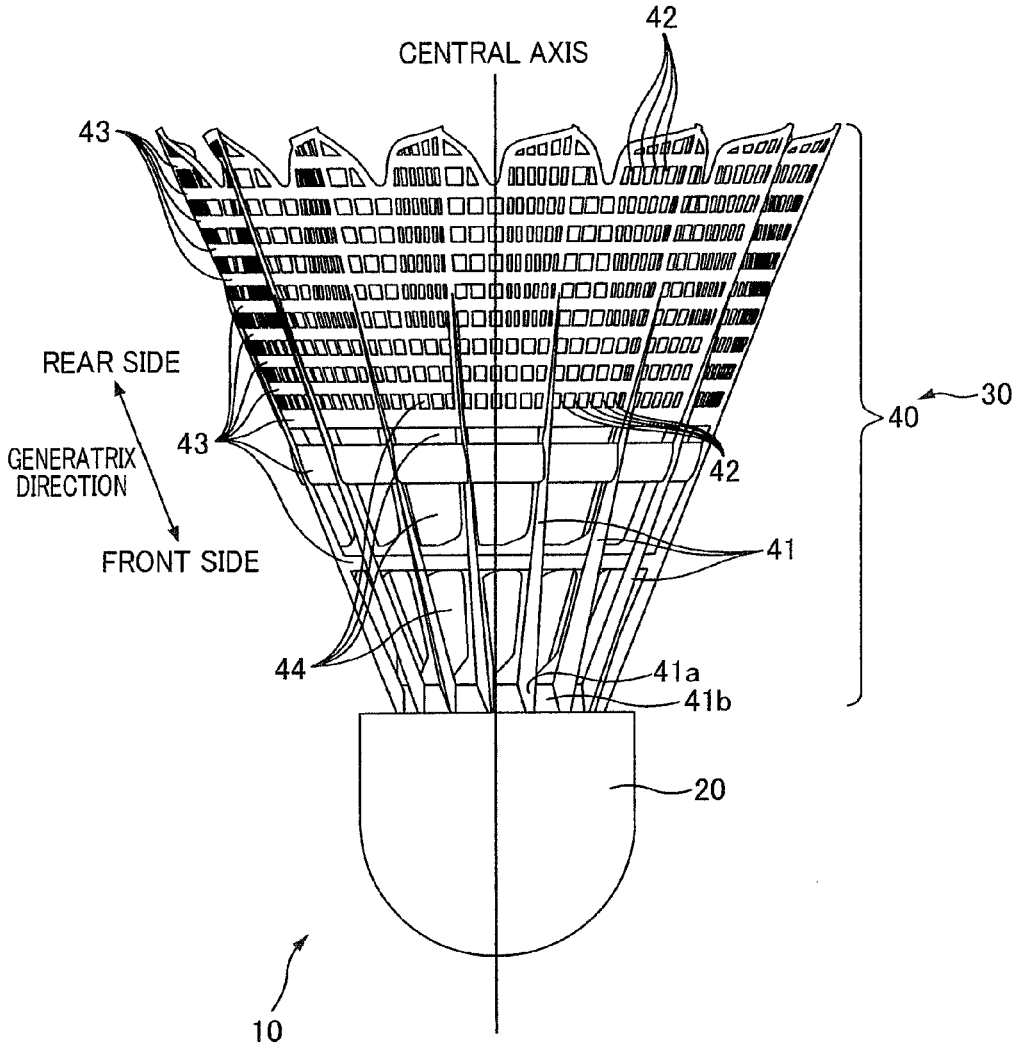
FIG. 1 is a first external view of a shuttlecock 10 of the present embodiment.

At least the following matters will be made clear by the description in the present specification and the accompanying drawings.

First, a shuttlecock including a cap and a skirt part whereto an air passage hole is formed, wherein a rib is provided to the skirt part, adjacent to a rear end of the air passage hole in a generatrix direction of the skirt part, the rib having a shape wherein air pressure difference is generated between an air flow passing through the air passage hole to flow on an inside of the rib and an air flow not passing through the air passage hole but to flow on an outside of the rib, and an aerodynamic force directed from the inside of the rib to the outside is generated.

According to this shuttlecock, even in the case where the skirt part collapses, the skirt part is pushed out to spread by the aerodynamic force acting on the rib, and thereby the skirt part is capable of being promptly recovered to its original state (that is, a state before collapse).

Further, in the above shuttlecock, it is possible that a cross sectional contour of the rib has a streamline shape as the shape, the cross section achieved by cutting with a virtual plane including a central axis of the skirt part, and an outside part of the contour positioned on an outside of a virtual straight line is longer than an inside part of the contour that is positioned on the inside of the virtual straight line, the virtual straight line connecting both ends of the streamline shape in a direction along the generatrix direction.

According to such structure, an aerodynamic force directed from the inside of the rib to the outside can be appropriately generated.

Further, in the above shuttlecock, it is possible that the outside part includes two curved lines having radius of curvatures different from each other, the radius of curvature of the curved line positioned on a front side that is closer to the cap in the generatrix direction, of the two curved lines, is smaller than the radius of curvature of the curved line positioned on a rear side further distant from the cap in the generatrix direction, a boundary between the two curved lines is positioned on the front side, of the front side and the rear side, and the inside part includes curved-line parts positioned at both ends of the inside part, and a straight-line part positioned at a center thereof.

Further, in the above shuttlecock, it is possible that in a case where the shuttlecock is hit, the virtual straight line inclines so that a rear end further distanced from the cap, of both ends of the virtual straight line, is positioned inside of a front end closer to the cap. In this way, when the shuttlecock is hit, the aerodynamic force further increases due to the rib being subjected to the reaction of wind pressure.

Further, in the above shuttlecock, it is possible that the rib is a lateral rib formed over the whole circumference of the skirt part in a circumferential direction. According to such structure, an aerodynamic force is generated over the whole circumference of the skirt part in the circumferential direction. And as a result, the skirt part can be recovered appropriately.

Further, in the above shuttlecock, it is possible that the skirt part includes the two or more lateral ribs. According to such structure, the recovery performance of the skirt part is further improved.

Summary of Shuttlecock of the Present Embodiment

Figure 2:
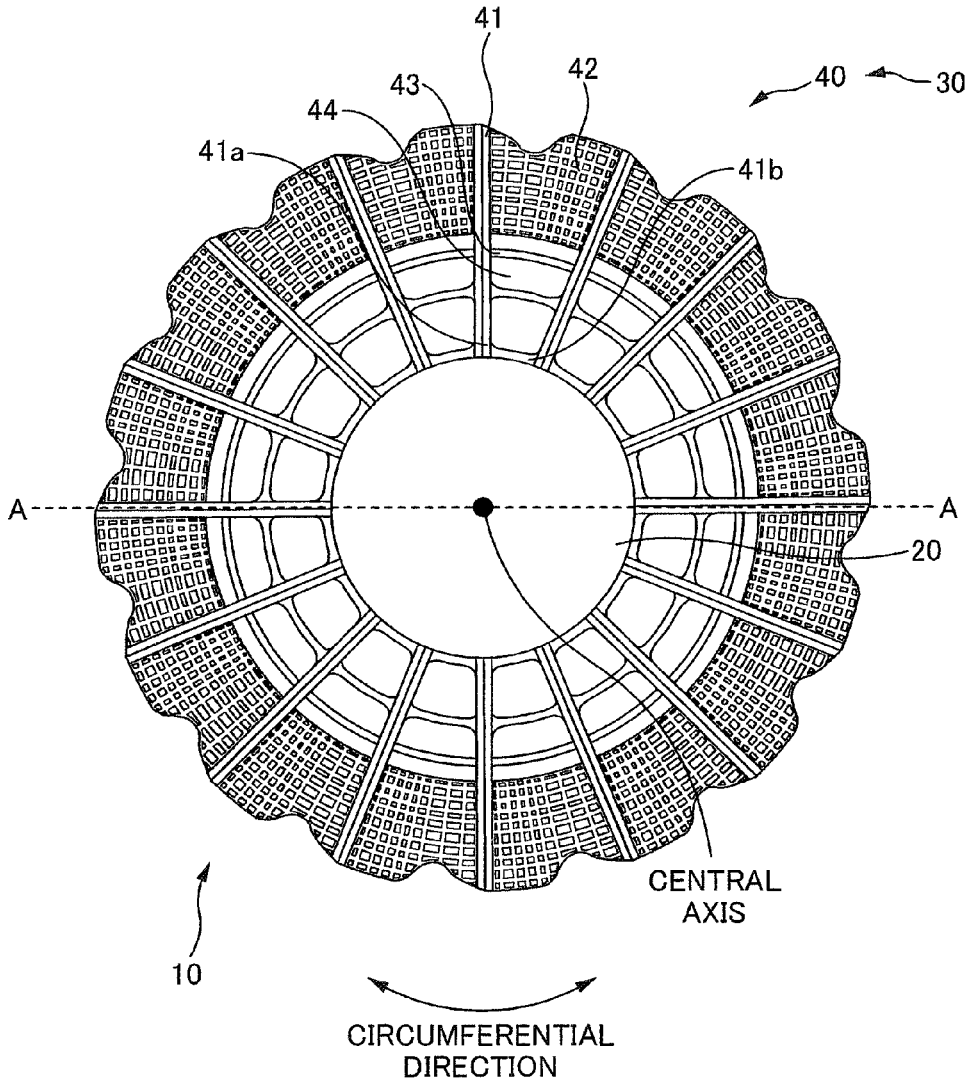
FIG. 2 is a second external view of the shuttlecock 10 of the present embodiment.

First, the basic structure of a shuttlecock 10 of the present embodiment will be explained with reference to FIGS. 1 and 2. FIGS. 1 and 2 show external views of the shuttlecock 10 of the present embodiment. FIG. 1 is a diagram of the shuttlecock 10 seen from the side. In FIG. 1, the central axis of the shuttlecock 10 is shown. Also in FIG. 1, a generatrix direction of the skirt part 40 (that is, the direction in which the skirt part 40 expands from the front to the rear in the central axis direction) is indicated by an arrow. FIG. 2 is a view of the shuttlecock 10 seen from the front. In FIG. 2, the circumferential direction of the skirt part 40 (more precisely, circumferential direction of an outer peripheral surface of the skirt part 40 centering on the central axis) is indicated by an arrow. In the description hereafter, along the central axis direction of the shuttlecock 10, the side provided with a cap 20 is referred to as the front and a side provided with a hem part of the skirt part 40 is referred to as the rear. That is, when seen from the skirt part 40, the side closer to the cap 20 in the generatrix direction of the skirt part 40 is the front side, and the side distant from the cap 20 is the rear side.

As shown in FIG. 1, the shuttlecock 10 of the present embodiment includes a cap 20 and a vane part 30. The cap 20 is a substantially dome-shaped member attached to a leading end of the shuttlecock 10. The vane part 30 is a member molded from synthetic resin such as polyether ester amide, polyamide, or polyester and includes a joint part 32 (refer to FIG. 3) and the skirt part 40 provided at the rear of the joint part 32.

The joint part 32 joins the cap 20 and the vane part 30. The cap 20 and the vane part 30 are joined by fitting the joint part 32 into a hole (not shown) provided in the cap 20.

The skirt part 40 consists of a plurality of main stems 41, vertical ribs 42, and lateral ribs 43 as shown in FIG. 1. These components are integrally molded from the above mentioned synthetic resin. Also, the skirt part 40 is elastic. Therefore, for example, the skirt part 40 is elastically deformed so as to collapse when the shuttlecock 10 is struck by a racket 100 (refer to FIG. 4). Further, the skirt part 40 according to the present embodiment is a so-called flared skirt type that includes a hem part waving along the peripheral direction of the skirt part 40.

The main stem 41 is a part radially extending from the cap 20 (more precisely, a face of the cap 20, opposing the skirt part 40) toward the rear end of the skirt part 40 in the generatrix direction of the skirt part 40. Further, root parts 41*a* (front end parts) of the main stems 41 are provided with connection parts 41*b* that connect the main stems in the circumferential direction of the skirt part 40. The vertical ribs 42 disposed between the main stems 41 are reinforcement ribs formed along the generatrix direction of the skirt part 40 from the center to the rear end of the skirt part 40 in the generatrix direction.

The lateral ribs 43 are reinforcement ribs formed along the circumferential direction of the skirt part 40. As shown in FIG. 2, the lateral ribs 43 are formed along the circumferential direction, and is formed over the whole circumference in the peripheral direction except for the lateral rib 43 positioned at the rearmost end in the generatrix direction. Also, the lateral ribs 43 intersect with the main stems 41 and the vertical ribs 42. That is, grids are formed by the main stems 41, the vertical ribs 42, and the lateral ribs 43. Thus, a plurality of substantially square-shaped air passage holes 44 are formed on the skirt part 40. In other words, the lateral ribs 43 are adjacent to the rear ends of each air passage holes 44 in the generatrix direction. Details of the lateral ribs 43 will be described later.

When struck by the racket 100, the shuttlecock 10 with the above mentioned structure flies in the air while rotating about the central axis. As the shuttlecock 10 flies, an air flow flowing in a direction opposing the flying direction of the shuttlecock 10 (that is, an air flow flowing from the front to the rear in the central axis direction of the shuttlecock 10) is generated. The air flow is directed to the skirt part 40, and a part thereof passes through the air passage holes 44 to flow inside the skirt part 40.

Shape of Lateral Ribs

Next, shapes of the plurality of lateral ribs 43 mentioned above will be explained with reference to FIGS. 3A to 3D.

Figure 3A:
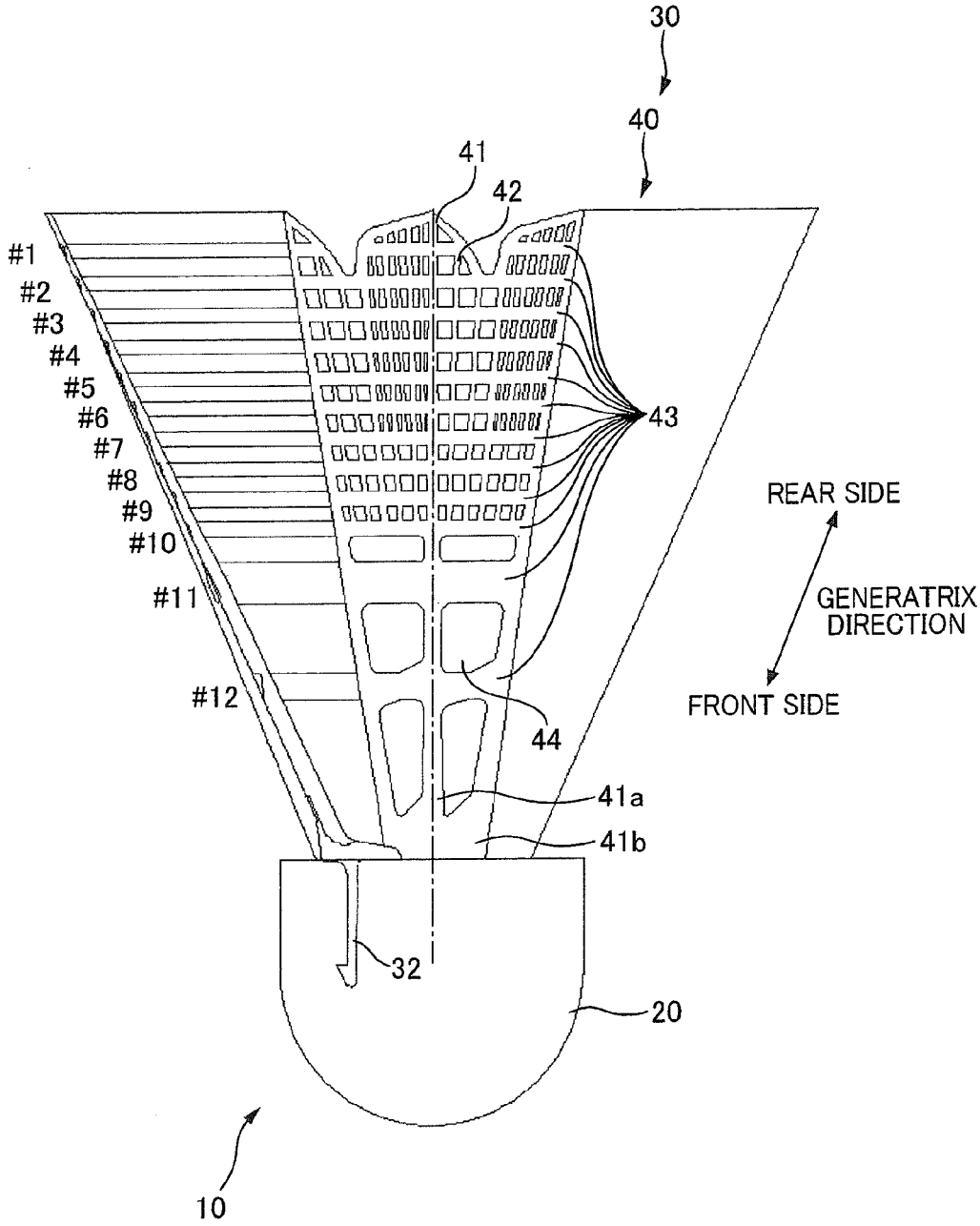
FIG. 3A is a cross-sectional view of the shuttlecock 10 taken along plane A-A of FIG. 2.
Figure 3B:
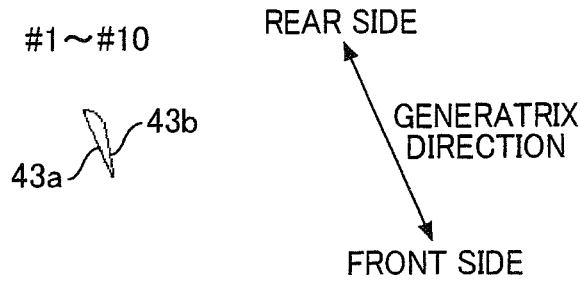
FIG. 3B is a cross-sectional view of #1 to #10 lateral ribs 43.
Figure 3C:
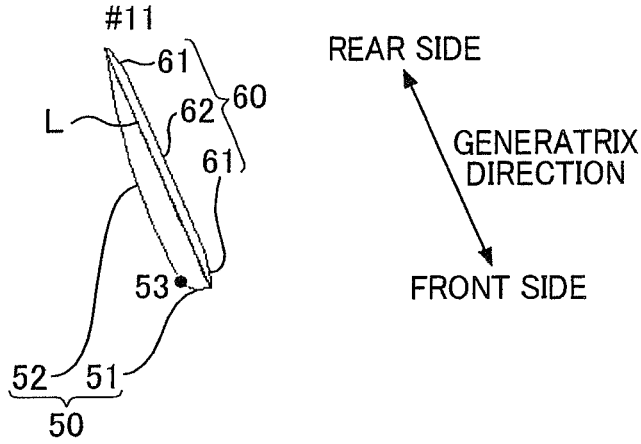
FIG. 3C is a cross-sectional view of the #11 lateral rib 43.
Figure 3D:
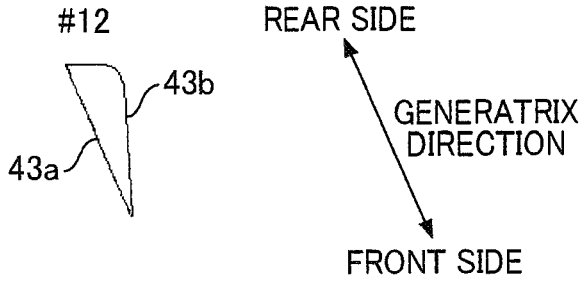
FIG. 3D is a cross-sectional view of the #12 lateral rib 43.

FIG. 3A is a cross-sectional view of the shuttlecock 10 taken along plane A-A of FIG. 2 (hereafter, simply referred to as also the cross section). In FIG. 3A, the generatrix direction of the skirt part 40 is indicated by an arrow. The plurality of lateral ribs 43 shown in FIG. 3A are numbered in the descending order toward the rear-end side in the generatrix direction (#1 to #12). For example, the lateral rib 43 positioned closest to the front-end side is numbered #12. FIGS. 3B to 3D are enlarged cross-sectional views of each of the lateral ribs 43 shown in FIG. 3A. FIG. 3B describes a cross section of the #1 to #10 lateral ribs 43. FIG. 3C describes a cross section of the #11 lateral rib 43. FIG. 3D describes a cross section of the #12 lateral rib 43. In each FIGS. 3B to 3D, the generatrix direction is indicated by an arrow.

As described above, each of the plurality of lateral ribs 43 (except the #1 lateral rib 43) is formed over the whole circumference of the skirt part 40 in the peripheral direction. And the cross section of each of the lateral ribs 43 taken along the plane A-A which is a virtual plane including the central axis of the skirt part 40 (that is, the central axis of the shuttlecock 10) are shown in FIGS. 3B to 3D. Also, in the present embodiment, the shape of the #11 lateral rib 43, of the plurality of lateral ribs 43 described above, is different from the shapes of the other lateral ribs 43.

The cross sections of the #1 to #10, and #12 lateral ribs 43, of the plurality of lateral ribs 43, are substantially triangular as shown in FIGS. 3B and 3D. And the contour of the cross section consists of an outside straight-line 43*a* provided along the generatrix direction of the skirt part 40 and an inside curved-line 43*b* that is curved to swell toward the inside of the skirt part 40. And the length of the inside curved-line 43*b* is longer than the length of the outside straight-line 43*a*.

On the other hand, the cross section of the #11 lateral rib 43, of the plurality of lateral ribs 43, has a wing-shaped cross section as shown in FIG. 3C. And the cross section has a streamline contour (that is, the cross section of the #11 lateral rib 43 has a shape where the contour thereof is in a streamline shape). In other words, the cross section of the #11 lateral rib 43 is elongated along the generatrix direction of the skirt part 40, and has a pointed rear end (that is, the curvature of the rear end of the contour is larger than the curvature of the front end.)

Further explaining the cross section of the #11 lateral rib 43 in detail, the virtual straight line L that connects the front end and the rear end of the contour of the cross section (that is, the virtual straight line L that connects both ends of the streamline shape) is inclined with respect to the central axis direction of the skirt part 40, and lies along the generatrix direction of the skirt part 40. That is, the #11 lateral rib 43 is disposed to incline with respect to the central axis. Therefore, the #11 lateral rib 43 is provided in the skirt part 40 in a state where the virtual straight line L inclines at an angle of attack θ (refer to FIG. 5) with respect to the air flow flowing from the front in the central axis direction.

Also, the contour of the cross section of the #11 lateral rib 43 consists of an outside part 50 positioned outside of the virtual straight line L of the skirt part 40, and an inside part 60 positioned inside of the virtual straight line L of the skirt part 40.

The inside part 60 consists of curved-line parts 61 positioned at both end parts thereof, and a straight-line part 62 positioned at a center part thereof. The outside part 50 consists of two curved lines having radius of curvatures different from each other, that are, a curved line on the front side 51 that is positioned further to the front, and a curved line on the rear side 52 that is positioned further to the rear. The radius of curvature of the curved line on the front side 51 (in the present embodiment, about 0.4 mm) is smaller than the radius of curvature of the curved line on rear side 52 (in the present embodiment, about 10 mm). A boundary point 53 between the curved line on the front side 51 and the curved line on the rear side 52 is positioned closer to the front, and the curved line on the front side 51 and the curved line on the rear side 52 are smoothly connected at the boundary point 53. And the length of the outside part 50 is longer than the length of the inside part 60.

Aerodynamic Force acting on Lateral Rib 43

Figure 4:
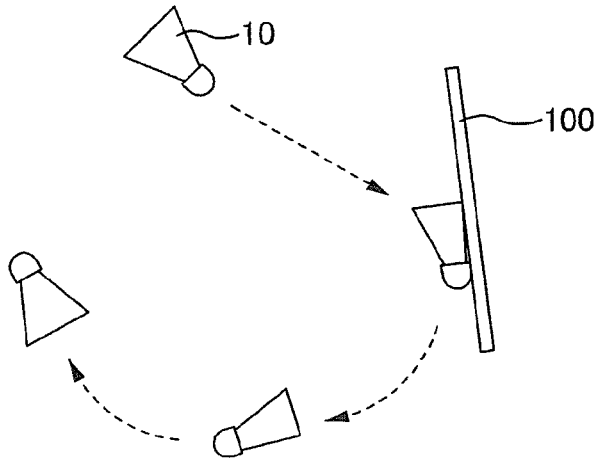
FIG. 4 is a schematic view showing the shuttlecock 10 flying in the air.
Figure 5:
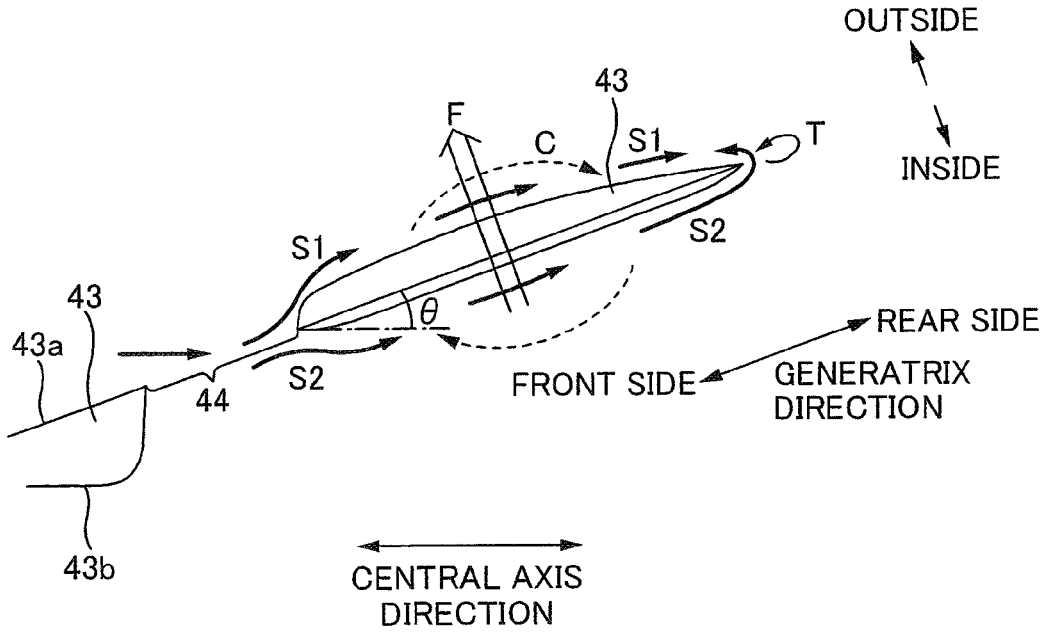
FIG. 5 is a diagram showing how an aerodynamic force is generated by the shape of the #11 lateral rib 43.
Figure 6A:
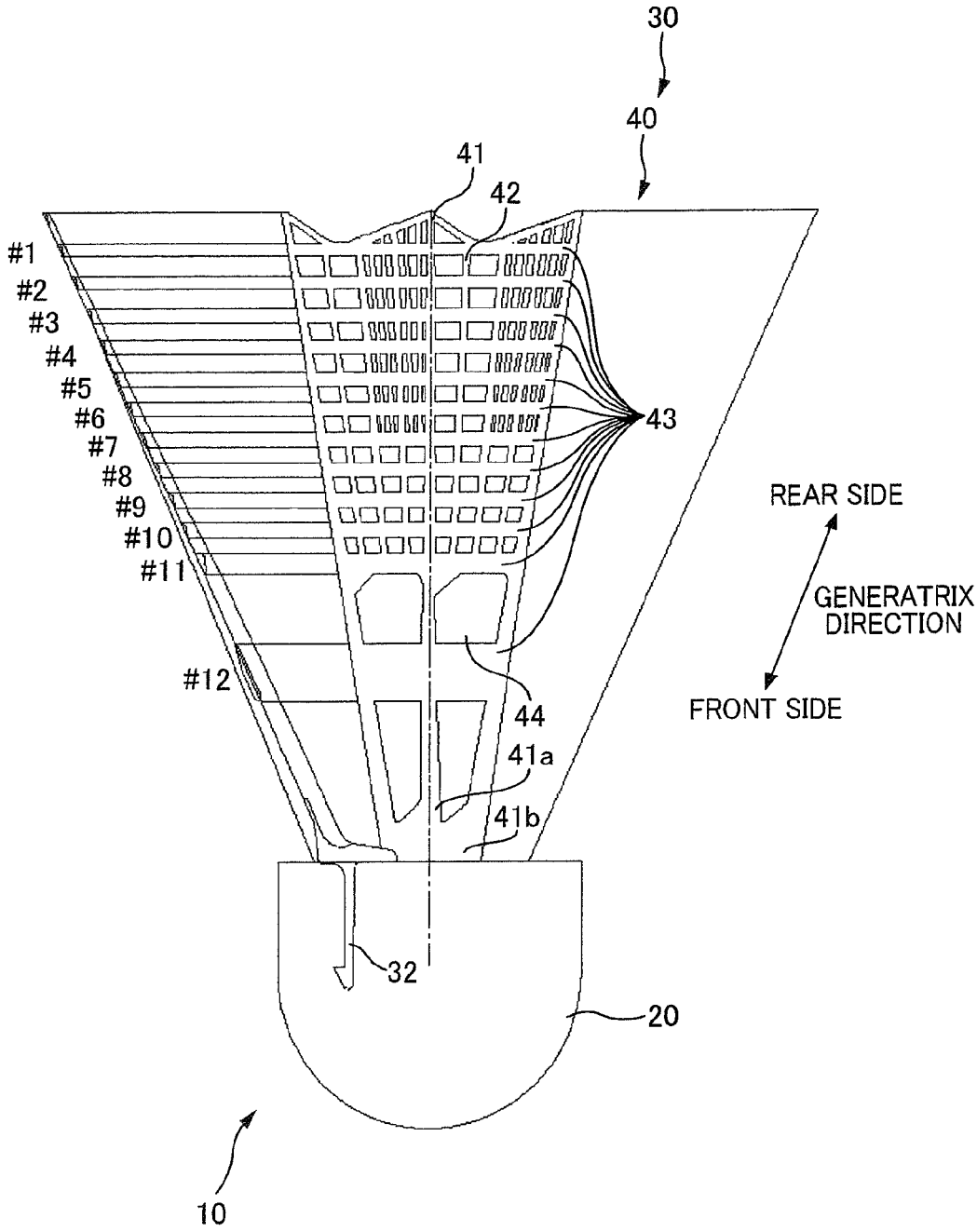
FIG. 6A is a first diagram showing a first modification example of the shuttlecock 10 according to the present invention.
Figure 6B:
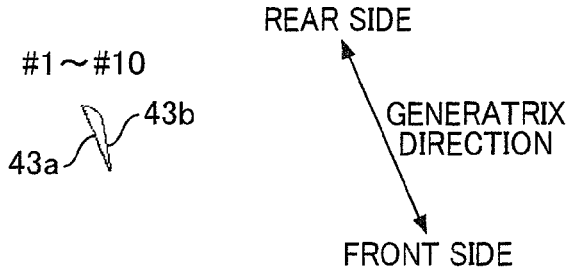
FIG. 6B is a second diagram showing the first modification example of the shuttlecock 10 according to the present invention.
Figure 6C:
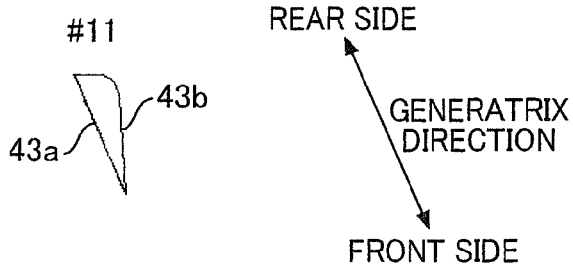
FIG. 6C is a third diagram showing the first modification example of the shuttlecock 10 according to the present invention.
Figure 6D:
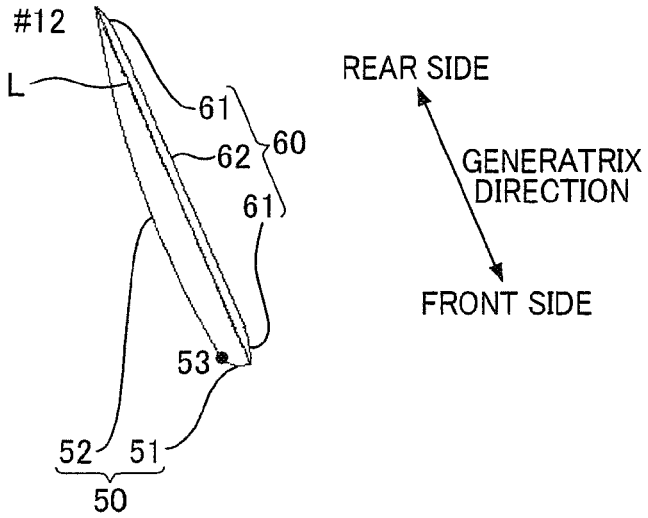
FIG. 6D is a fourth diagram showing the first modification example of the shuttlecock 10 according to the present invention.

Of the shapes of the lateral ribs 43 mentioned above, the shape of the #11 lateral rib 43 is of a shape causing air pressure difference between air flows flowing inside and outside of the lateral rib 43, whereby an aerodynamic force is generated to be directed from the inside of the lateral rib 43 to the outside. This will be described with reference to FIGS. 4 and 5. FIG. 4 is a schematic view showing the shuttlecock 10 flying in the air. FIG. 5 is a diagram showing how the aerodynamic force is generated by the shape of the #11 lateral rib 43. In FIG. 5, the generatrix direction and the central axis direction of the skirt part 40 are indicated by arrows.

As shown in FIG. 4, the skirt part 40 is elastically deformed so as to collapse when the shuttlecock 10 is struck by the racket 100. And thereafter, the shuttlecock 10 flies in the air away from the racket 100.

On the other hand, while the shuttlecock 10 is flying, an air flow directed to the skirt part 40 is generated in the central axis direction of the skirt part 40. And a part of the air flow is branched before reaching the front end in the generatrix direction of each of the lateral ribs 43 provided to the skirt part 40. That is, each of the plurality of lateral ribs 43 branches a part of the air flow directed to the skirt part 40. And a part of the air flow branched by the lateral rib 43 passes through the air passage hole 44 adjacent to the front end of the lateral rib 43 (that is, the air passage hole 44 is adjacent to the lateral rib 43 at the front of the lateral rib 43) and flows around to the inside of the lateral rib 43. And another part of the branched air flow flows outside of the lateral rib 43 without passing through the air passage hole 44.

As a matter of course, the branching of the air flow mentioned above also occurs because of the #11 lateral rib 43. That is, the position where the #11 lateral rib 43 is provided in the generatrix direction of the skirt part 40 is a position where the air flow directed to the skirt part 40 can be branched by the #11 lateral rib 43. Specifically, the #11 lateral rib 43 is provided in a position at a distance of greater than or equal to 10 mm from the face, of the cap 20, opposing the skirt part 40. That is, the space between the #11 lateral rib 43 and the above-mentioned opposing face is secured sufficiently to the extent that the air flow reaches the front of the #11 lateral rib 43. Thereby, as shown in FIG. 5, the air flow directed to the skirt part 40 is branched at the front of the #11 lateral rib 43. And a part of the branched air flow (indicated by reference symbol S1 in FIG. 5) flows outside of the #11 lateral rib 43, and the remaining branched air flow (indicated by reference symbol S2 in FIG. 5) passes through the air passage hole 44 adjacent to the front end of the #11 lateral rib 43 and flows inside of the #11 lateral rib 43. Further, since the contour of the cross section of the #11 lateral rib 43 has a streamline shape, the air flow S1 flows along the outer surface of the #11 lateral rib 43 (the surface in which the line of intersection with the A-A plane is the outside part 50), and the air flow S2 flows along the inner surface of the #11 lateral rib 43 (the surface in which the line of intersection with the A-A plane is the inside part 60).

Further, the distance of the air flow S2 flowing along the inner surface of the #11 lateral rib 43 (that is, the length of the inside part 60) is shorter than the distance of the air flow S1 flowing along the outer surface of the #11 lateral rib 43 (that is, the length of the outside part 50). Therefore, of the branched air flows, the air flow S2 reaches the rear end of the #11 lateral rib 43 faster than the air flow S1, and flows around to the outer surface of the lateral rib 43 as shown in FIG. 5. And the air flow S2 that has flowed around to the outer surface joins the air flow S1 at the rear end of the lateral rib 43.

By the way, when the air flow S2 flows from the inner surface and around to the outer surface of the #11 lateral rib 43, the air flow S2 flows by curving along the surface of the rear end of the #11 lateral rib 43. At that time, since the #11 lateral rib 43 has an acute rear end as described above, the flow speed of the air flow S2 becomes faster at the vicinity of the rear end of the #11 lateral rib 43. On the other hand, at the junction of the air flow S1 and the air flow S2 (so-called a stagnation part), the flow speed of the two air flows becomes approximately 0. In this way, a vortex (indicated by reference symbol T in FIG. 5) is generated when there is a difference in the flow speed of the air flows at a location between the stagnation part and the vicinity of the rear end of the #11 lateral rib 43, and a vortex T is released at the rear end of the #11 lateral rib 43 as shown in FIG. 5.

Further, according to the Kelvin circulation theorem, in the case where the vortex T is generated, a flow circulating in a direction opposite the rotation of the vortex (indicated by reference symbol C in FIG. 5) is generated around the #11 lateral rib 43. This circulation flow C is a flow that circulates in a direction shown by the broken lines in FIG. 5. That is, the circulation flow C flows from the front to the rear on the inside of the #11 lateral rib 43, and flows from the rear to the front on the outside of the lateral rib 43. A generation of such circulation flow C, increases the flow speed of the air flow S1 to become faster than the flow speed of the air flow before branching, while reducing the flow speed of the air flow S2 to become slower than the flow speed of the air flow before branching.

And according to Bernoulli's principle, the air pressure of the air flow S1 becomes lower than the air pressure of the air flow before branching, and the air pressure of the air flow S2 becomes higher than the air pressure of the air flow before branching. As a result, difference in air pressure is generated between the air flow S1 and the air flow S2 and due to such difference in air pressure, the aerodynamic force directed from the inside of the #11 lateral rib 43 to the outside is generated (indicated by reference symbol F in FIG. 5).

The aerodynamic force F acts to push the #11 lateral rib 43 outward. And as mentioned above, since the main stems 41, the vertical ribs 42, and the lateral ribs 43 are integrated, the skirt part 40 in a collapsed state is pushed to spread outside by forcing the #11 lateral rib 43 outward. Thereby, the skirt part 40 is recovered to its original state (a state before being struck by the racket 100) as shown in FIG. 4.

Also, in the present embodiment, when the shuttlecock 10 is struck by the racket 100 (that is, when it is hit by the racket 100), the #11 lateral rib 43 inclines so that the aforementioned angle of inclination (that is, the angle of attack θ) of the virtual straight line L with respect to the air flow changes. Specifically, when the shuttlecock 10 is hit, the virtual straight line L inclines so that the rear end further distant from the cap 20, of the two ends of the virtual straight line L, is positioned inside of the front end closer to the cap 20. Thereby, the #11 lateral rib 43 is subjected to the reaction of wind pressure when the shuttlecock 10 is hit, and as a result, the aerodynamic force F further increases to further improve the restoring performance of the skirt part 40.

Efficiency of Shuttlecock 10 of Present Embodiment

As described above, the #11 lateral rib 43 provided to the shuttlecock 10 of the present embodiment has a shape in which an air pressure difference is created between air flows S1 and S2, whereby an aerodynamic force F directed from the inside of the lateral rib 43 to the outside is generated. Thereby, even if the skirt part 40 should collapse by being struck by the racket 100, the skirt part 40 can be promptly recovered to its original state.

More specifically, in order to generate an aerodynamic force F directed from the inside of the lateral rib 43 to the outside, each of the air flows branched by the lateral rib 43 to flow inside and outside of the lateral rib 43 (that are, the air flow S1 and the air flow S2) needs to flow along the surface of the lateral rib 43. Therefore, in the present embodiment, the #11 lateral rib 43 has a shape such that the contour of the cross section thereof is a streamline shape. Further, in order to generate an aerodynamic force F, the air flow flowing inside of the lateral rib 43 needs to flow around to the outside of the lateral rib 43, and the branched flows need to join at the rear end of the lateral rib 43. Therefore, in the present embodiment, the length of the outside part 50 is made longer than the length of the inside part 60 of the cross-sectional contour of the #11 lateral rib 43. With the #11 lateral rib 43 having the above-mentioned shape, the aerodynamic force F directed from the inside of the lateral rib 43 to the outside can be appropriately generated while the shuttlecock 10 is flying in the air after being struck by the racket 100 (in other words, while the air flow is being generated in the direction opposing the travelling direction of the shuttlecock 10).

And it becomes possible to recover the skirt part 40 to its original state promptly by the aerodynamic force F pushing and spreading out the skirt part 40. Thereby, an appropriate air resistance is offered to the flying shuttlecock 10. Therefore, the shuttlecock 10 picks up proper flying speed provided by the strike (that is, the flying speed of the shuttlecock 10 becomes accurate), and the shuttlecock 10 flies only an appropriate distance.

As a result of achieving the above-mentioned effects, problems in conventional shuttlecocks (specifically, conventional shuttlecocks having vane parts made of synthetic resin) are solved. That is, it becomes possible to appropriately prevent the shuttlecock from flying too fast or flying beyond the back boundary line which are caused by the shuttlecock 10 not being subject to appropriate air resistance after the skirt part 40 collapses. In this way, the player can play badminton in a way he wants. Further, the faster the flying speed of the shuttlecock 10 after being struck by the racket 100 becomes (in other words, the faster the flow speed of the air flow that flows in the opposite direction of the flying direction of the shuttlecock 10 becomes), the larger the aerodynamic force F becomes. That is, when the shuttlecock 10 is struck, especially smashed, that highly increases the flying speed of the shuttlecock 10, the effect of the present invention that is to improve the recovery performance of the shuttlecock 10 will be exerted more efficiently.

Further, as a result of achieving the improvement in the recovery performance of the shuttlecock whose vane is made of a synthetic resin member (hereafter, referred to as a synthetic shuttlecock), it becomes possible to provide a synthetic shuttlecock having a performance as high as a high-grade shuttlecock that uses waterfowl or ground bird feather (hereafter, referred to as a natural shuttlecock). More specifically, a natural shuttlecock can be promptly recovered even when the natural shuttlecock collapses by being smashed by the racket 100 because of its high rigidity. On the other hand, it was difficult for a conventional synthetic shuttlecock to recover promptly because of its low rigidity. In contrast, the recovery performance of the shuttlecock 10 of the present embodiment is improved without increasing its rigidity.

Thereby, a synthetic shuttlecock having cost performance and durability almost equal to that of a conventional synthetic shuttlecock, and of performance not far behind from a natural shuttlecock can be provided.

Also, in the present embodiment, the #11 lateral rib 43 is provided to the skirt part 40 so that the aforementioned virtual straight line L lies along the generatrix direction of the skirt part 40. To generate an aerodynamic force F further efficiently with such configuration, it is preferable that the angle (that is, the angle of attack θ shown in FIG. 5) at which the virtual straight line L inclines with respect to the air flow direction directed to the skirt part 40 (that is, the central axis direction) is small.

Especially, when the shuttlecock 10 is hit resulting with the virtual straight line L inclining so that the rear end of the #11 lateral rib 43 in the generatrix direction is positioned inside the front end when, as described before, the #11 lateral rib 43 is subjected to the reaction of wind pressure and thus the aerodynamic force F further increases. In other words, when the angle of attack θ is a positive angle in the case where the rear end of the #11 lateral rib 43 is positioned inside of the front end when seen from the flow direction of the air flow (for example, a state shown in FIG. 5), the aerodynamic force F further increases if the angle of attack θ changes to a negative angle.

Also, in the present embodiment, the #11 lateral rib 43 is formed over the whole circumference of the skirt part 40 in the circumferential direction, therefore an aerodynamic force F is generated in the whole circumferential area of the skirt part 40 in the peripheral direction. That is, the skirt part 40 is pushed and spread out in the peripheral direction impartially, and thereby the skirt part 40 in a collapsed state is recovered to its original state appropriately.

Other Embodiment

In the description above, the shuttlecock 10 of the present invention has been explained based on the above mentioned embodiments. However, the above mentioned embodiments are provided for the purpose of facilitating the understanding of the present invention and do not give any limitation to the present invention. It goes without saying that any modifications and improvements to the present invention can be made without departing from the spirit of the invention and the present invention includes its equivalents.

Also, in the above mentioned embodiment, the cross sectional contour of the #11 lateral rib 43 consisted of the outside part 50 composed of the two curved lines having radius of curvatures different from each other, and the inside part 60 composed of the curved-line parts 61 positioned at both ends thereof, and the straight-line part 62 positioned in the center part thereof. And the radius of curvature of the front side 51 curved line of the outside part 50 is smaller than the radius of curvature of the rear side 52 curved line, and the boundary point 53 of the two curved lines is positioned in the front side. However, there is no limitation to this, and the shape of the #11 lateral rib 43 can be of any shape as long as the shape generates an aerodynamic force F. And at least it is possible to generate an aerodynamic force F appropriately as long as the contour of the cross section of the lateral rib 43 has a streamline shape, and the outside part 50 is longer than the inside part 60.

Also in the above mentioned embodiment, of the plurality of lateral ribs 43, it was the #11 lateral rib 43 that has a shape for generating an aerodynamic force F. However, there is no limitation to this. For example, as shown in FIGS. 6A to 6D, those beside the #11 lateral rib can have such shape. FIGS. 6A to 6D are diagrams showing the case in which the #12 lateral rib 43 has such shape as a first modification example of the shuttlecock 10 according to the present invention, where FIGS. 6A to 6D correspond to FIGS. 3A to 3D.

Figure 7A:
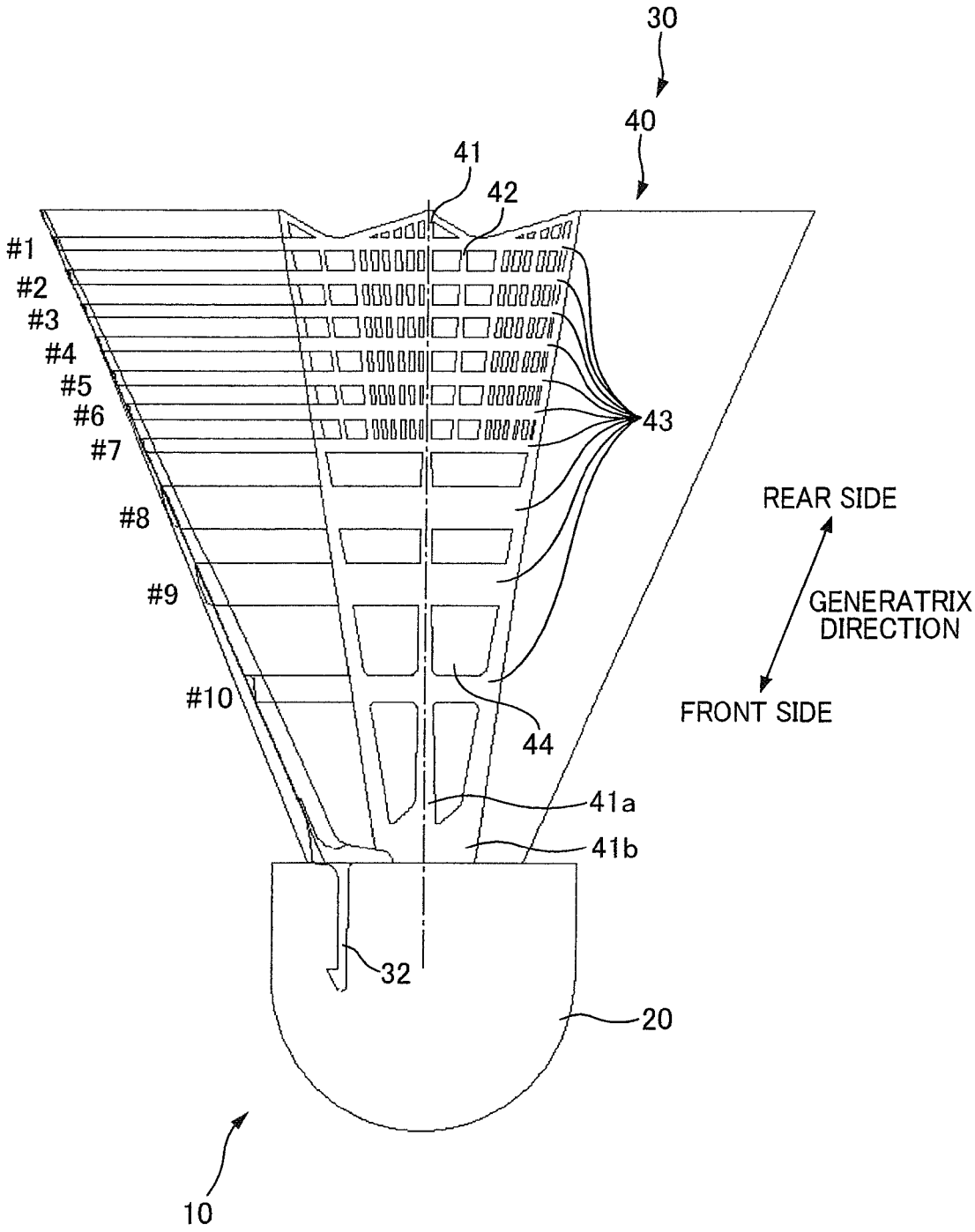
FIG. 7A is a first diagram showing a second modification example of the shuttlecock 10 according to the present invention.
Figure 7B:
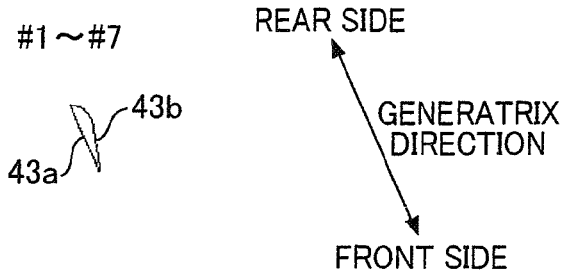
FIG. 7B is a second diagram showing the second modification example of the shuttlecock 10 according to the present invention.
Figure 7C:
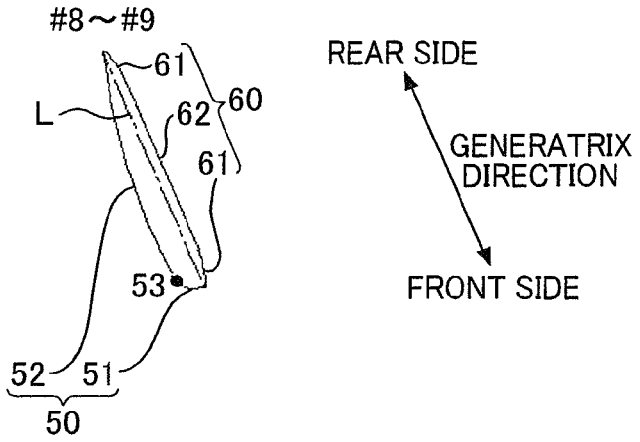
FIG. 7C is a third diagram showing the second modification example of the shuttlecock 10 according to the present invention.
Figure 7D:
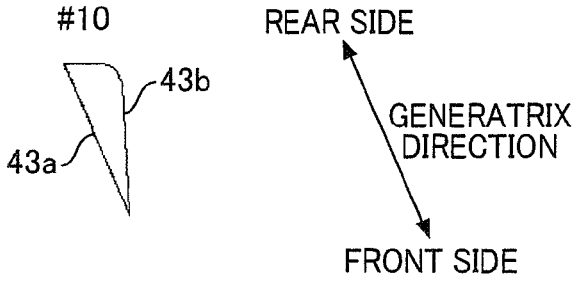
FIG. 7D is a fourth diagram showing the second modification example of the shuttlecock 10 according to the present invention.
Figure 8A:
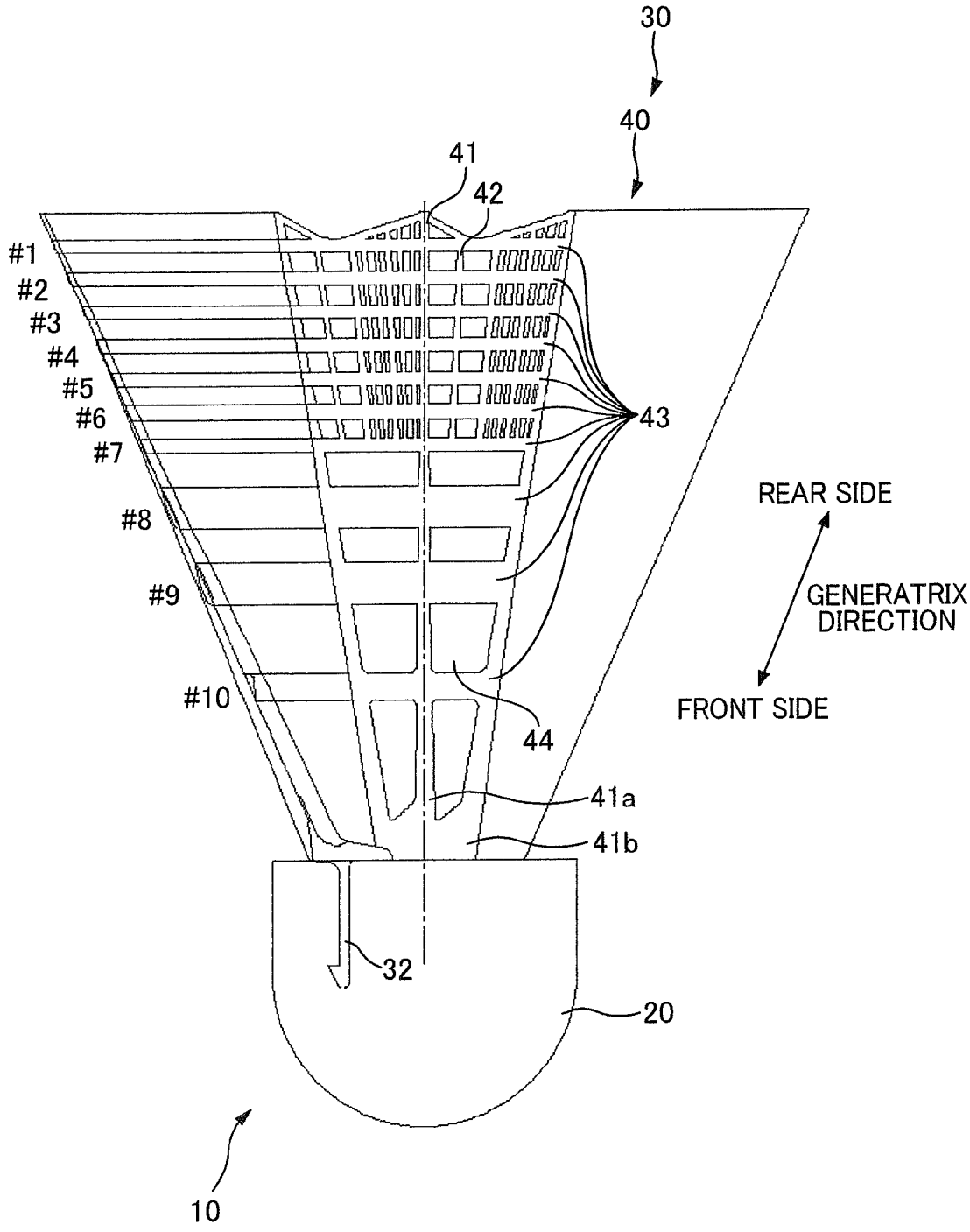
FIG. 8A is a first diagram showing a third modification example of the shuttlecock 10 according to the present invention.
Figure 8B:
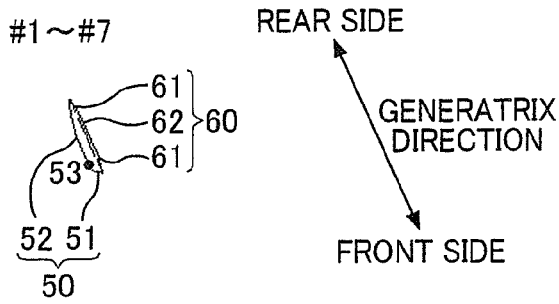
FIG. 8B is a second diagram showing the third modification example of the shuttlecock 10 according to the present invention.
Figure 8C:
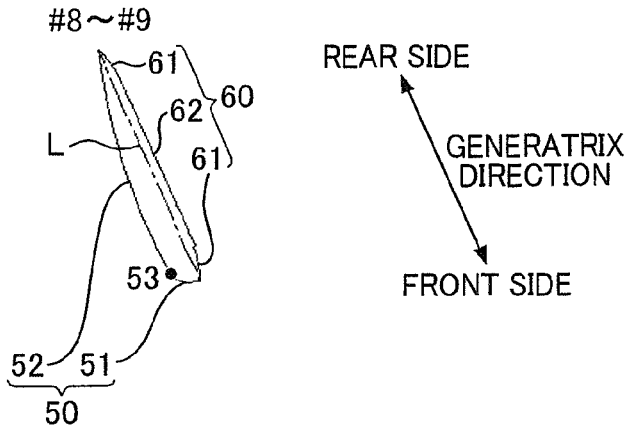
FIG. 8C is a third diagram showing the third modification example of the shuttlecock 10 according to the present invention.
Figure 8D:
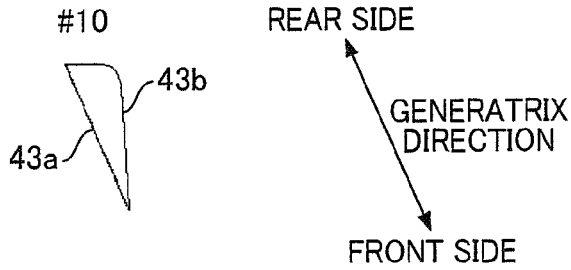
FIG. 8D is a fourth diagram showing the third modification example of the shuttlecock 10 according to the present invention.

Also in the above mentioned embodiment, of the plurality of lateral ribs 43, only the #11 lateral rib 43 has the above mentioned shape. That is, in the above mentioned embodiments an example in which the skirt part 40 includes only one lateral rib 43 having the above mentioned shape has been explained. However, there is no limitation to this. For example, as shown in FIGS. 7A to 7D, and FIGS. 8A to 8D, the skirt part 40 can have two or more lateral ribs 43 having the above mentioned shape. FIGS. 7A to 7D are diagrams showing a second modification example of the shuttlecock 10 according to the present invention. A cross section of the shuttlecock 10 according to the second modification example is shown in FIG. 7A. And enlarged cross sections of each of the lateral ribs 43 of the shuttlecock 10 according to the second modification example are shown in FIGS. 7B to 7D. FIGS. 8A to 8D are diagrams showing a third modification example of the shuttlecock 10 according to the present invention. A cross section of the shuttlecock 10 according to the third modification example is shown in FIG. 8A. And enlarged cross sections of each of the lateral ribs 43 of the shuttlecock 10 according to the third modification example are shown in FIGS. 8B to 8D.

Both the second modification example and the third modification example are examples in which a plurality of lateral ribs 43 having the shape for generating the aerodynamic force F are provided. The number of lateral ribs 43 having the shape for generating the aerodynamic force F is increased in the second modification example and the third modification example, whereby the area in which the aerodynamic force F is generated is increased. As a result, the recovery performance of the skirt part 40 is further improved. Further, the shuttlecocks 10 shown in FIGS. 7A and 8A have the skirt parts 40 including lateral ribs 43 from #1 to #10. In the shuttlecock 10 shown in FIG. 7A, two of the lateral ribs 43 (specifically, the #8 and #9 lateral ribs 43) have the above mentioned shape (refer to FIGS. 7A to 7D). In the shuttlecock 10 shown in FIG. 8A, nine of the lateral ribs 43 (specifically, the #1 to #9 lateral ribs 43) have the above mentioned shape (refer to FIGS. 8A to 8D).

REFERENCE SIGNS LIST

10: shuttlecock, 20: cap, 30: vane part, 32: joint part, 40: skirt part, 41: main stem, 41*a*: root part, 41*b*: connection part, 42: vertical rib, 43: lateral rib, 43*a*: outer straight-line part, 43*b*: inner curved-line part, 44: air passage hole, 50: outside part, 51: curved line on front-side, 52: curved line on rear side, 53: boundary point, 60: inside part, 61: curved-line part, 62: straight-line part, 100: racket

The invention claimed is:

1. A shuttlecock including a cap and a skirt part whereto an air passage hole is formed, comprising:

a rib provided to the skirt part, adjacent to a rear end of the air passage hole in a generatrix direction of the skirt part, the rib having a shape wherein air pressure difference is generated between an air flow passing through the air passage hole to flow on an inside of the rib and an air flow not passing through the air passage hole but to flow on an outside of the rib, and an aerodynamic force directed from the inside of the rib to the outside is generated.

2. A shuttlecock according to claim 1, wherein a cross sectional contour of the rib has a streamline shape as the shape, the cross section achieved by cutting with a virtual plane including a central axis of the skirt part, and an outside part of the contour positioned on an outside of a virtual straight line is longer than an inside part of the contour that is positioned on the inside of the virtual straight line, the virtual straight line connecting both ends of the streamline shape in a direction along the generatrix direction.

3. A shuttlecock according to claim 2, wherein the outside part includes two curved lines having radius of curvatures different from each other, the radius of curvature of the curved line positioned on a front side that is closer to the cap in the generatrix direction, of the two curved lines, is smaller than the radius of curvature of the curved line positioned on a rear side further distant from the cap in the generatrix direction, a boundary between the two curved lines is positioned on the front side, of the front side and the rear side, and the inside part includes curved-line parts positioned at both ends of the inside part, and a straight-line part positioned at a center thereof.

4. A shuttlecock according to claim 3, wherein in a case where the shuttlecock is hit, the virtual straight line inclines so that a rear end further distant from the cap is positioned inside of a front end closer to the cap, the rear end and the front end being two ends of the virtual straight line.

5. A shuttlecock according to claim 1, wherein the rib is a lateral rib lengthening over a whole circumference of the skirt part in a circumferential direction.

6. A shuttlecock according to claim 5, wherein the skirt part includes two or more of the lateral ribs.

* * * * *